United States Patent [19]

Luthi

[11] 4,217,170

[45] Aug. 12, 1980

[54] PULP WASHER DISCHARGING A LOW CONSISTENCY PULP SLURRY

[75] Inventor: Oscar Luthi, Nashua, N.H.

[73] Assignee: Ingersoll-Rand Company, Woodcliff Lake, N.J.

[21] Appl. No.: 7,095

[22] Filed: Jan. 29, 1979

Related U.S. Application Data

[63] Continuation of Ser. No. 852,907, Nov. 18, 1977, abandoned.

[51] Int. Cl.[2] ..... D21C 9/06

[52] U.S. Cl. ..... 162/380; 68/43; 210/217

[58] Field of Search ..... 100/37, 73, 74, 75, 100/121; 8/156; 68/22 R, 43, 158, 181 R; 210/402, 403, 404, 217; 162/60, 317, 380

[56] References Cited

U.S. PATENT DOCUMENTS

| | | | |
|---|---|---|---|
| 1,870,971 | 8/1932 | Sundstrom et al. | 162/317 X |
| 2,500,056 | 3/1950 | Barr | 210/402 X |
| 2,999,785 | 9/1961 | Richter | 162/60 |
| 3,616,660 | 11/1971 | Ingermarsson | 68/22 R |
| 3,878,698 | 4/1975 | Friksson et al. | 68/43 X |
| 4,085,003 | 4/1978 | Luthi | 162/317 X |

FOREIGN PATENT DOCUMENTS

| | | | |
|---|---|---|---|
| 580146 | 7/1959 | Canada | 210/404 |
| 96482 | 8/1939 | Sweden | 210/403 |

*Primary Examiner*—Richard V. Fisher
*Attorney, Agent, or Firm*—Frank S. Troidl

[57] ABSTRACT

A substantially air-tight vat completely encloses the rotatable cylinder. The pulp slurry fed into the vat is compacted to form a mat of high consistency. The differential pressure across the circumferential wall of the rotatable cylinder washes the mat with liquid contained in the wash chamber. The mat is removed from the cylindrical wall of the rotatable cylinder to provide a low consistency pulp slurry.

2 Claims, 5 Drawing Figures

10
12
13
14
16
17
18
20
22
24
26
28
30
74
76

PULP WASHER DISCHARGING A LOW CONSISTENCY PULP SLURRY

This is a continuation, of application Ser. No. 852,907 filed Nov. 18, 1977, now abandoned.

This invention relates to pulp washers. More particularly this invention is a new pulp washer and pulp washing method for use in providing a low consistency pulp slurry output.

The cooked pulp from the digesters is filtered and washed with water to remove the black liquor that would contaminate the end product made from pulp and to recover the maximum amount of spent cooking chemicals with minimum dilution. Most of the pulp washing today is done in vacuum washers. Normally, two to four washers are operated in series depending upon the amount of pulp being handled, from maximum washing efficiency. Between 98 and 99% of the spent chemicals are thus washed out of the pulp.

The vacuum washer is a wire cloth covered cylinder which rotates in a vat containing the pulp slurry, the lower section of the cylinder being submerged in the pulp. Vacuum is applied as the rotating cylinder enters the pulp slurry. The black liquor drains through the wire cloth, leaving a layer of pulp upon the face of the wire as held there by the vacuum inside the cylinder. The layer of pulp continues to build up as the submerged portion of the cylinder rotates through the pulp slurry in the vat. As the cylinder continues to rotate, the thick layer of pulp adhering to the face of the wire emerges from the slurry. Black liquor continues to drain from the pulp as a result of the differential pressure between the external atmosphere and the vacuum within the cylinder. Showers are located over the pulp mat to displace the black liquor with water as the cylinder continues to rotate. Finally, the vacuum is cut-off and the washed pulp is removed from the wire of the cylinder just before the cycle is repeated.

It is not possible to displace all the original liquor and chemicals with wash water in the washing zone. For this reason, the pulp mat discharged from the first vacuum washer is re-pulped or re-slurried before traveling over the second vacuum filter. This is repeated between each vacuum filter in the washing sequence. The pulp and fresh water flow counter-current to each other in multi-stage washing in order to minimize dilution of the black liquor. Thus, fresh water is used to wash the pulp on the last stage washer and the filtrate or water that was pulled through the pulp mat by the vacuum on this washer is used to wash the pulp on the preceding washer.

The pulp slurry fed to a vacuum washer stage is usually of about 1% consistency. Some slough-off will occur at the cylinder emergence point. The outermost layers of the pulp mat have a very low consistency and don't have enough strength to be lifted out of submergence. The sloughed-off pulp is re-diluted with the inflowing pulp slurry. The consistency of the pulp mat at emergence is approximately 7 to 9% due to sloughing and the vacuum action. The pulp mat then goes through the washing zone and thereafter more liquor is extracted by air being sucked through the mat. The pulp is removed from the cylinder at a relatively high consistency of 12% to 16% with a take-off scraper. The high consistency must be diluted to a lower consistency and re-pulped before entering the next washing stage.

A disadvantage of currently used vacuum filters of the type described above is that liquor extraction by air is undesirable in many processes because of foaming and chemical reactions.

This invention is a pulp washer and pulp washing method which, among other things, eliminates air as an aid to extract liquor. The pulp is washed in the complete absence of any air. The discharged pulp slurry has a low consistency to permit the pulp slurry to be easily piped out of a totally enclosed vat. In order not to lose washing efficiency, the original liquor is extracted to a high consistency in the compaction zone before the washing zone.

Briefly described, this new pulp washer includes a rotatable cylinder which is enclosed by an air-tight vat. Means are provided for feeding a pulp slurry into the vat. The pulp slurry is compacted to form a mat of high consistency after which the mat is washed by liquid contained in a wash chamber by the application of a differential pressure across the circumferential wall of the rotatable cylinder. The mat is removed from the rotatable cylinder to provide a low consistency pulp slurry.

The invention as well as its many advantages may be further understood by reference to the following detailed description and drawings in which.

In the various Figures, like parts are referred to by like numbers.

Figures 1, 2:
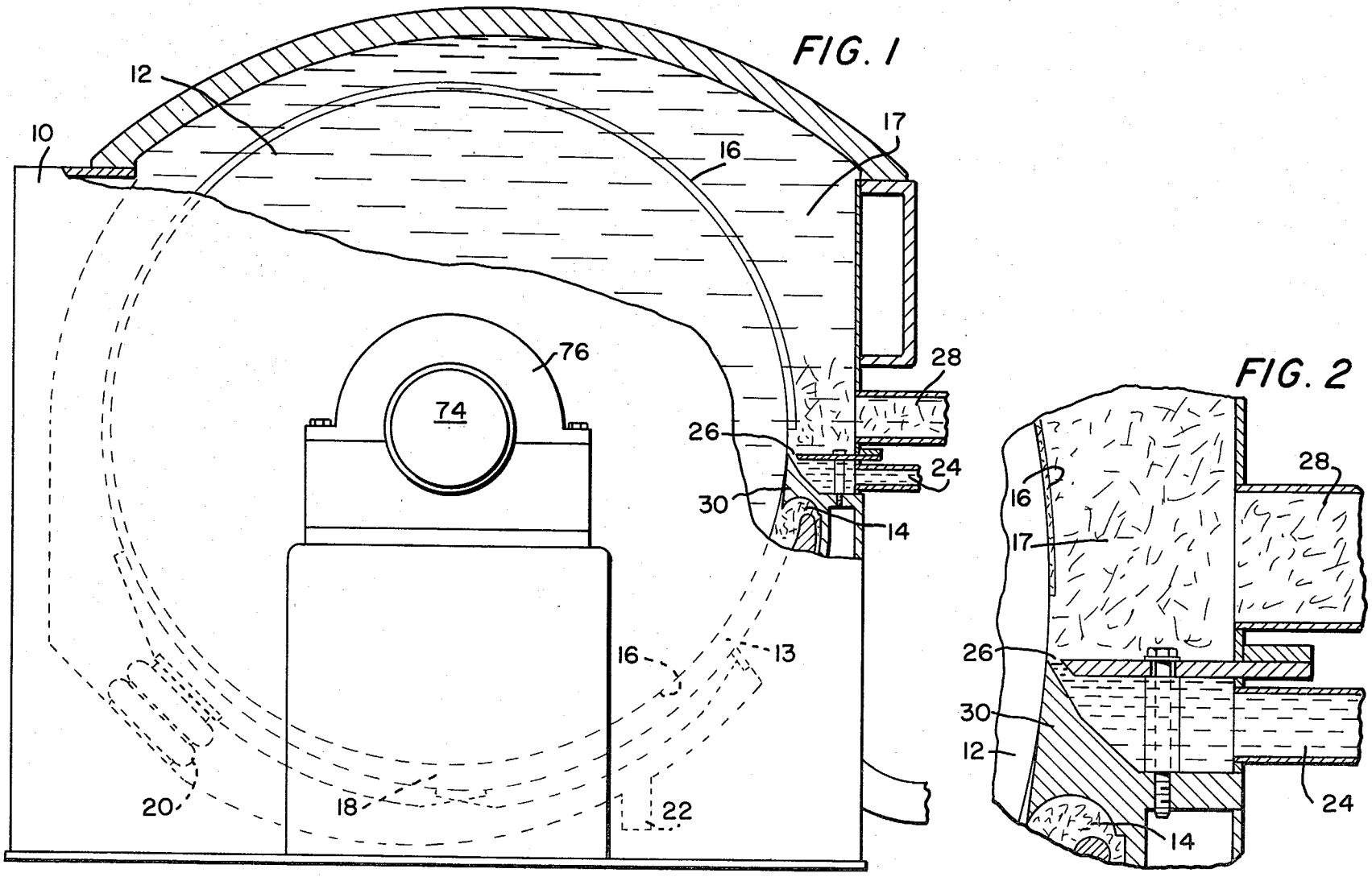
FIG. 1 is a front view partly in section showing one embodiment of the invention.
FIG. 2 is a sectional view on an enlarged scale showing the application of a liquid jet against the formed and washed mat to remove the mat.

Referring to the drawings and more particularly to FIG. 1, a substantially air-tight vat 10 completely encloses a wire cloth covered cylinder 12 which rotates in the vat 10. The rotatable cylinder 12 has its lower section submerged in the pulp slurry which is introduced into the pulp slurry chamber 13 by means of pulp slurry inlet 14.

As the cylinder rotates, a pulp mat 16 is formed on the cylinder. This pulp mat may be compacted with a hydrodynamic baffle 18 shown by the broken lines in FIG. 1. The specially constructed compacting baffle 18 mounted downstream from the pulp slurry inlet 14 applies a compacting force against the mat being formed. The force is applied by means of actuators 20 (one shown in FIG. 1). The hydro-dynamic baffle 18 is preferably of a type that will compact the mat to a high consistency of, say, 15% to 18% before entering the washing zone. A particularly good hydro-dynamic baffle is shown and described in U.S Pat. No. 4,085,003 issued Apr. 18, 1978. With this new apparatus and method a further compaction after the mat has been compacted by the baffle 18 is unnecessary. During the remaining portion of the turning cycle of the rotatable cylinder 12, the compacted pulp mat is washed by the application of a differential pressure across the circumferential wall of the rotatable cylinder 12. The mat 16 is washed with the wash liquid contained in the liquid filled wash chamber 17 which extends at least from the mat forming and compaction zone to the low consistency pulp outlet 28. The wash liquid enters wash chamber 17 through wash liquid inlet 22 and also aids the actuators 20 in the application of the compaction force against the mat.

In the embodiment shown, the mat is removed from the outside of the cylinder 12 by a liquid ejected against the mat. In the mat discharge zone, a valve (not shown) shuts off the low pressure inside cylinder 12. The liquid is fed to the vat 10 through liquid inlet 24 and ejected through the longitudinal slot 26 and against the formed mat to remove the mat from the cylinder 12. The thus formed low consistency pulp slurry is discharged from the vat 10 through outlet 28. The discharged pulp slurry may have a relatively low consistency of, say, 4% consistency. Many mat removal devices other than the liquid jet shown may be used to remove the mat, such as a vaned roll.

A longitudinally extending excluder type seal 30 separates the wash chamber 17 at the mat take off area from the pulp slurry chamber 13 at inlet 14. The pressure in the wash chamber is kept the same as the pressure in the pulp slurry chamber.

Figure 4:
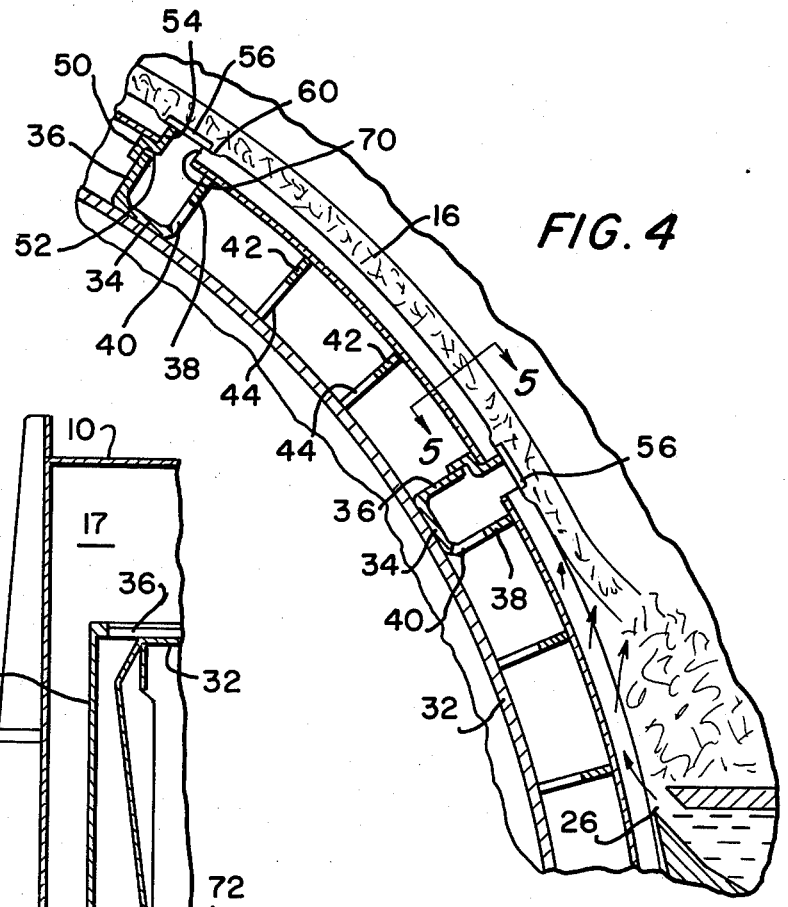
FIG. 4 is a sectional view on an enlarged scale illustrating a structure for preventing the intermixing of the liquid which is in the filtrate compartments of the cylinder as they leave the forming and compaction zone with the wash liquid.

Preferably, the cylinder 12 includes an inner cylinder 32 as shown in FIG. 4, on which are mounted longitudinally extending division grids 34. Each of the longitudinally extending division grids 34 are generally U-shaped in cross-section and include a completely solid radially extending member 36 and a radially extending member 38 having notches 40. Radially extending circumferentially spaced support grids 42 having notches 44 are mounted in circumferentially spaced relationship between the division grids 34.

A corrugated separating baffle 46 (see FIG. 5) provides flow channels 48 for the flow of liquor through mat 16, wire mesh 49, and circumferentially along the flow channels 48. Each of the circumferential segments formed between the division grids 34 and under baffle 46 constitute a filtrate compartment.

The radially extending part 36 of the division grids 34 has its radially outward portion extending alongside of a member including a radially extending portion 50, an integral circumferentially extending portion 52 which extends over the outside of radially extending portion 36 of division grid 34, and also under and in contact with baffle 46, and an integral radially extending portion 54 extending across one end of baffle 46 to block off that end of the baffle. Longitudinally extending plates 56 are mounted on recesses 60 formed on baffles 46. Thus, the wash liquor which flows through the mat 16 and wire mesh 49 also flows along the flow channels 48 in a direction opposite to the direction of rotation of the drum 12. At the end of the flow channel 48 the wash liquor flows through the port 70, notch 40 and notches 44 and longitudinally through the filtrate compartment formed between the division grids 34. The filtrate in each filtrate compartment flows to the end of the drum. Thus, it can be seen that the surface of the cylinder 12 is constructed with a plurality of filtrate compartments which prevent or minimize the intermixing of the washing liquid applied across the mat 16 in the washing zone with the liquid in the filtrate compartments which remains in the filtrate compartments after the filtrate compartments leave the mat forming and compaction section of the vat.

Figure 3:
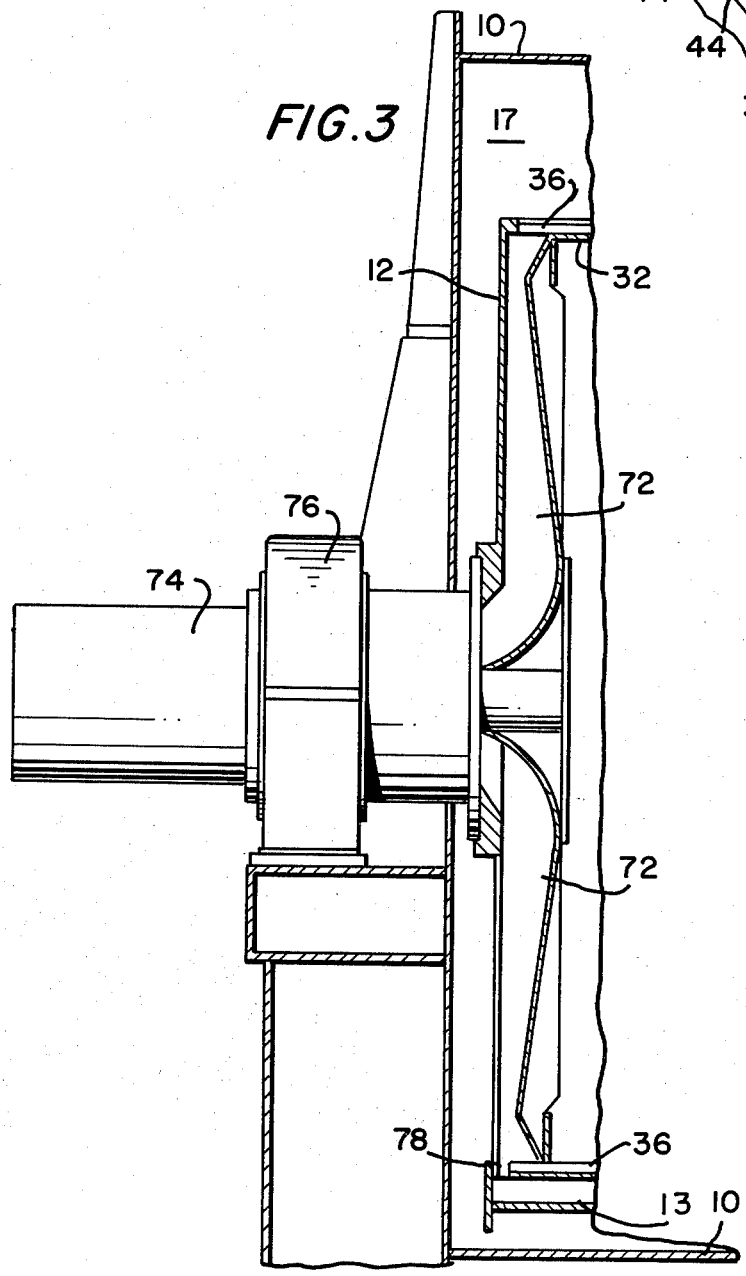
FIG. 3 is a fragmentary, sectional, side elevational view of the filtrate discharge portion of the apparatus of FIG. 1.

As shown more clearly in FIG. 3, the filtrate flows longitudinally to the ends of the cylinder 12 and then radially through channels 72 to the inside of the cylinder and then out of the vat through the hollow shaft 74 mounted for rotation within the shaft support 76. The pressure in the pulp slurry chamber 13 is, as previously mentioned, kept at about the same pressure as the pressure in the wash chamber 17. Therefore, it is only necessary to use an excluder seal 78 at the end of the cylinder.

In operation and looking at FIG. 1, the pulp having a consistency of, say, around 4% consistency is fed into the pulp washer through pulp inlet 14 and into the pulp slurry chamber 13. As the cylinder rotates the pulp mat 16 begins to form in the forming and compaction zone. The wash water fed into the wash chamber 17 along with the actuators 20 applies a compaction force against the forming pulp mat as the pulp mat moves through the compaction zone.

The pulp mat is continuously washed from the time the pulp mat leaves the compaction zone, until the mat is removed.

Figure 5:
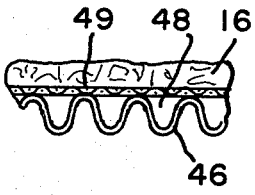
FIG. 5 is a sectional view taken generally along lines 5—5 of FIG. 4.

Because of the structure of the outside portions of the drum as shown in FIG. 4 and FIG. 5, the original liquor which was fed into the chamber 13 through inlet 14 which is pressed into the filtrate compartments by the compactor 18 is kept separated from the wash liquid which is applied through the mat 16 from wash chamber 17. The corrugated baffles support the wire mesh at frequent intervals and form the small flow channels 48 (see FIG. 5) for liquor passage. The size of these flow channels is such that they are large enough for the flow requirement, especially the inrush flow velocity at the start of the forming cycle and small enough to make sure that all the original liquor is flushed out of the flow channels by the wash liquor before the take off point is reached.

I claim:

1. A pulp washer comprising: a rotatable cylinder; a substantially air tight vat completely enclosing said rotatable cylinder; means for feeding a pulp slurry into said vat and partially along said rotatable cylinder; means for discharging a low consistency pulp slurry from the vat; means directly following the means for feeding the pulp slurry partially along said rotatable cylinder for forming and compacting the pulp slurry to form a mat of high consistency; a liquid filled wash chamber extending at least from the forming and compaction means to the means for discharging the low consistency pulp slurry; and means for applying a differential pressure across the circumferential wall of the rotatable cylinder to wash the mat with the liquid in the wash chamber.

2. The pulp washer of claim 1 wherein: the surface of the cylinder is provided with a plurality of filtrate compartments, said filtrate compartments being constructed so that intermixing of the washing liquid with the liquid remaining in the filtrate compartments after the compartments leave the mat forming and compaction means is minimized.

* * * * *